US007571514B2

(12) United States Patent
Shih

(10) Patent No.: US 7,571,514 B2
(45) Date of Patent: Aug. 11, 2009

(54) DUST ABSORPTION HEAD OF A VACUUM CLEANER

(76) Inventor: Tung-Han Shih, No. 22.,Industrial 14th Road, Tali City, Taichung county (TW) 412

( * ) Notice: Subject to any disclaimer, the term of this patent is extended or adjusted under 35 U.S.C. 154(b) by 174 days.

(21) Appl. No.: 11/820,542

(22) Filed: Jun. 21, 2007

(65) Prior Publication Data

US 2008/0313847 A1 Dec. 25, 2008

(51) Int. Cl.
*A47L 9/06* (2006.01)

(52) U.S. Cl. ..... 15/393; 15/398; 15/415.1; 15/363; 15/400

(58) Field of Classification Search ..... 15/347, 15/363, 393–400, 414, 415.1
See application file for complete search history.

(56) References Cited

U.S. PATENT DOCUMENTS 2,296,429 A * 9/1942 Ell ..... 15/399
4,972,541 A * 11/1990 Smith, Jr. ..... 15/105
6,574,830 B2 * 6/2003 Huddleston ..... 15/388
6,802,104 B1 * 10/2004 Redd ..... 15/393
7,437,797 B2 * 10/2008 Ptak et al. ..... 15/398

* cited by examiner

*Primary Examiner*—Dung Van Nguyen

(57) ABSTRACT

A dust absorption head of a vacuum cleaner including a main socket tube, a mounting cap, a vane wheel, a partition sleeve, and a dust absorption brush wheel to serve for attachment to a dust absorption pipe of a vacuum cleaner and for a rotational dust-absorption operation. The main socket tube and the mounting cap include at corresponding places an engaging projection and a plurality of positioning holes, allowing for adjustment of the operation angle of the dust absorption head according to different requirements. Meanwhile, a natural rotation of the vane wheel in response to the suction airflow of a vacuum cleaner is ensured for bringing the dust absorption brush wheel into rotation, thereby efficiently enhancing the dust-absorption effect.

1 Claim, 3 Drawing Sheets

DUST ABSORPTION HEAD OF A VACUUM CLEANER

BACKGROUND OF THE INVENTION

1. Fields of the Invention

The present invention relates to a dust absorption head of a vacuum cleaner, and more particularly to a structure that employs the suction airflow of a vacuum cleaner to achieve a natural rotation of the dust absorption brush wheel, thereby enhancing the dust absorption effect.

2. Description of the Related Art

The conventional vacuum cleaner (not shown) normally includes a plurality of expansion tubes and different kinds of suction heads that are engaged into the rear end surface of the body of the vacuum cleaner. In this way, they can be employed in accordance with user requirements. The plug-type connection belongs to the prior art so that no further descriptions thereto are given hereinafter. The invention relates to a dust absorption head for a vacuum cleaner.

As well-known, all kinds of dust absorption heads only have a fixed type suction head without the rotational dust absorption effect. Thus, the conventional dust absorption head cannot cover our needs when we require a dust absorption brush for a rotational cleaning of curtains, etc. Accordingly, the conventional dust absorption head requires further improvements.

SUMMARY OF THE INVENTION

It is a primary object of the invention to provide a dust absorption head of a vacuum cleaner that makes use of the suction airflow created by the vacuum cleaner and employs a vane wheel to bring the dust absorption brush wheel into a natural rotation for efficiently enhancing the dust absorption effect and the use value.

According to the invention, a dust absorption head of a vacuum cleaner includes a main socket tube, a mounting cap, a vane wheel, a partition sleeve, and a dust absorption brush wheel. The main socket tube and the mounting cap include at corresponding places an engaging projection and a plurality of positioning holes, allowing for adjustment of the operation angle of the dust absorption head according to different requirements. Meanwhile, a natural rotation of the vane wheel in response to the suction airflow of a vacuum cleaner is ensured for bringing the dust absorption brush wheel into rotation, thereby efficiently enhancing the dust-absorption effect.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
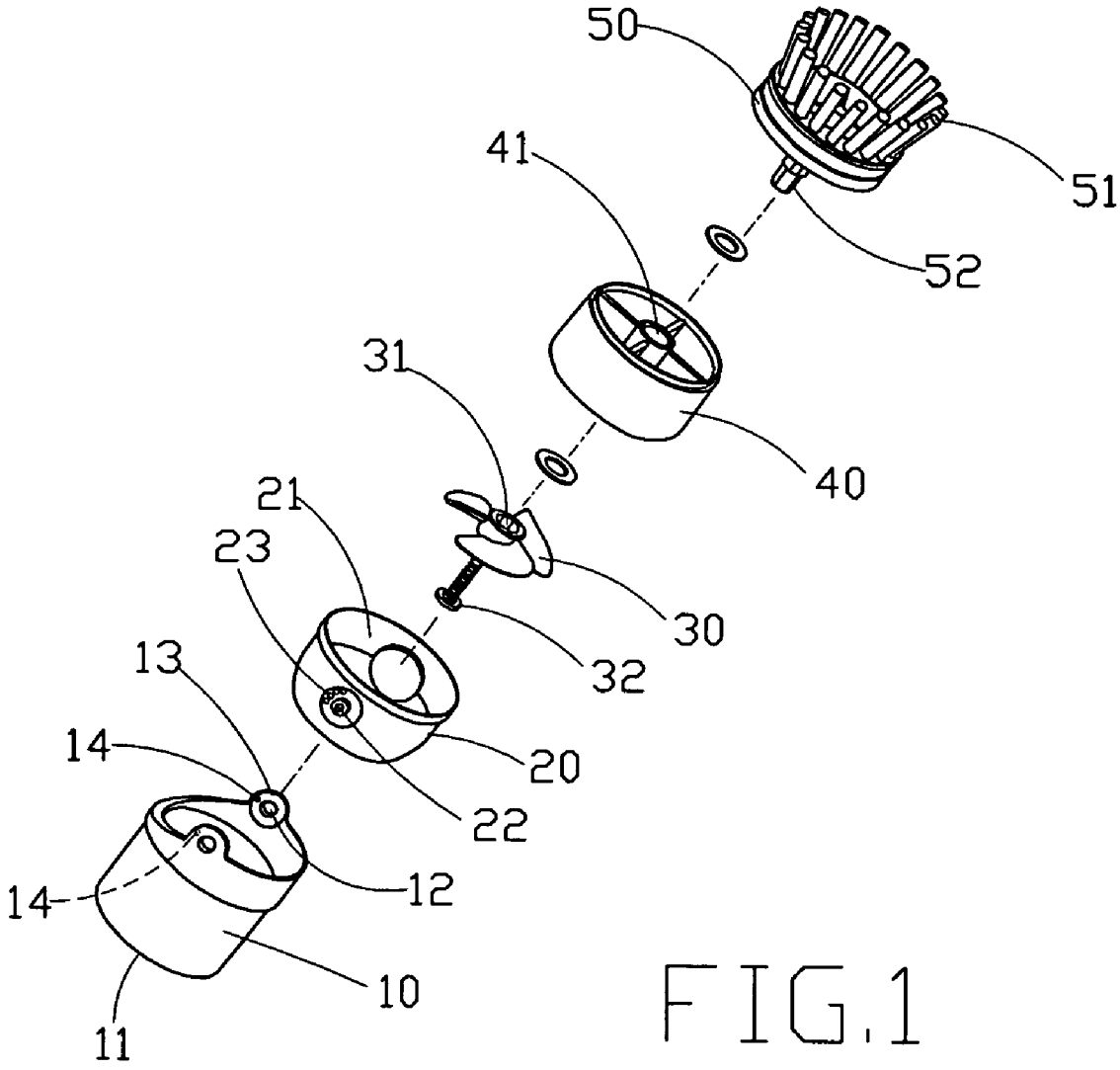
FIG. 1 is a partially exploded perspective view of a preferred embodiment of the invention.
Figure 2:
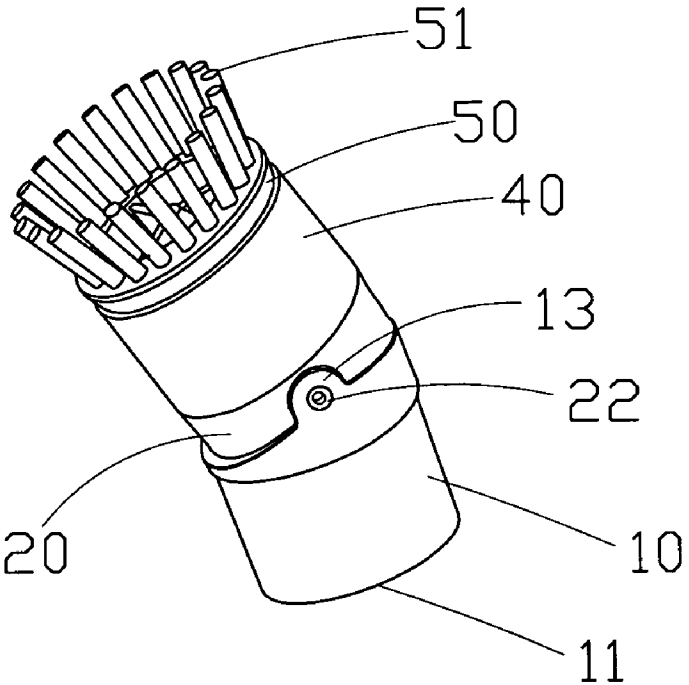
FIG. 2 is a perspective view of the preferred embodiment of the invention.
Figure 4:
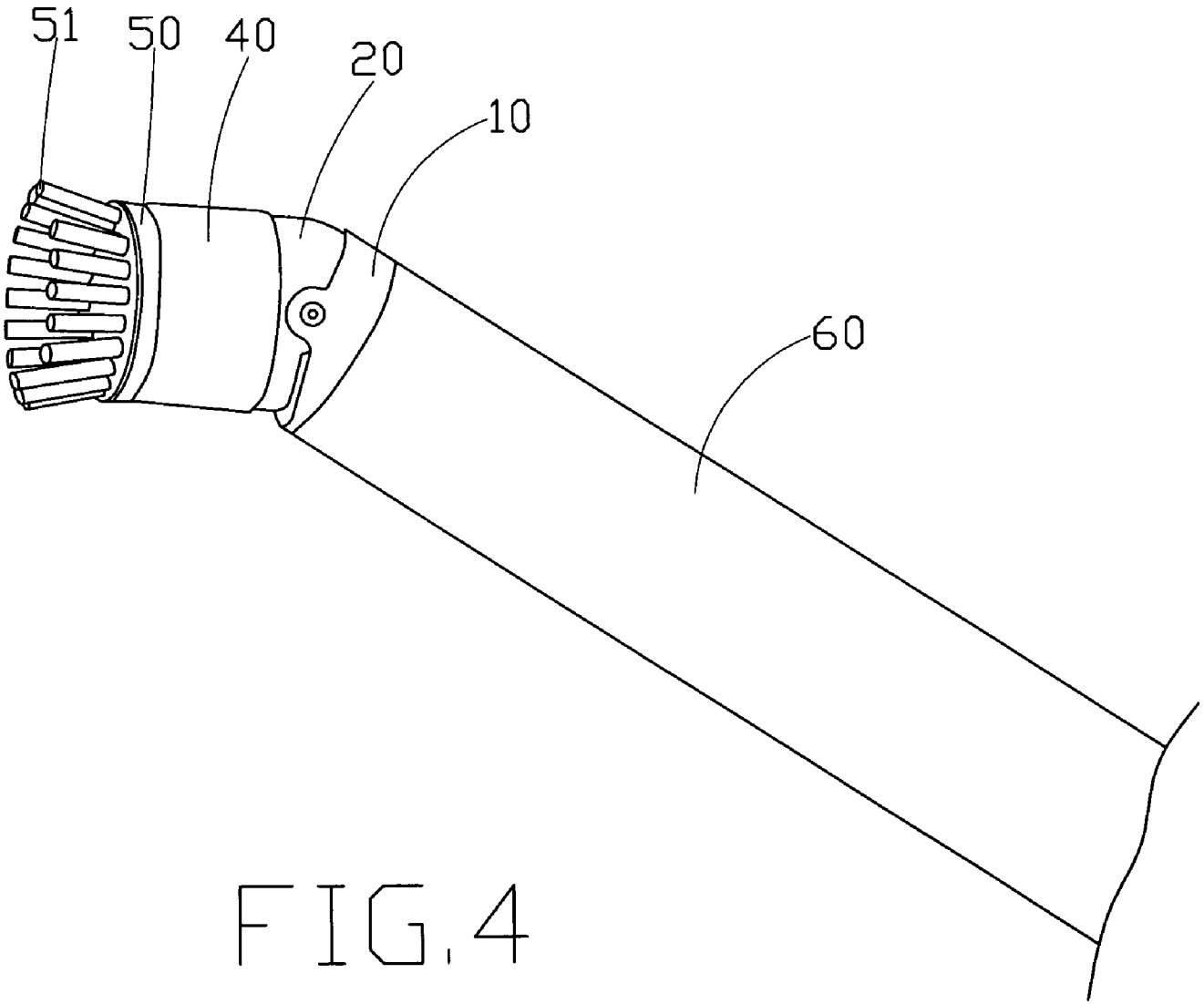
FIG. 4 is a perspective view of an application example of the invention.

As shown in FIGS. 1, 2 and 4, a dust absorption head in accordance with the invention includes a main socket tube 10, a mounting cap 20, a vane wheel 30, a partition sleeve 40, and a dust absorption brush wheel 50.

The main socket tube 10 is formed in a hollow shape with an opening end 11 for receiving a dust absorption pipe 60. A connecting ear 13 with a mortise 12 is disposed at the other end of the main socket tube 10. An engaging projection 14 is disposed at the internal side of the connecting ear 13.

The mounting cap 20 includes a brush-receiving chamber 21. A pivotal protrusion 22 is formed at the opposite sides of the external wall of the mounting cap 20 for achieving a pivotal interconnection of the pivotal protrusions 22 in the mortises 12 of the connecting ears 13 of the main socket tube 10. Meanwhile, a plurality of positioning holes 23 for engaging purpose are formed near one side of the pivotal protrusion 22 in match with the engaging projection 14 of the main socket tube 10 for the adjustment of different angles.

The dust absorption brush wheel 50 includes at the opening end thereof a brush 51 and at the opposing end a polygonal tenon 52.

The vane wheel 30 includes a polygonal hole 31 at the center thereof for receiving a screw element 32 to fix the dust absorption brush wheel 50 in place.

The partition sleeve 40 is interposed between the vane wheel 30 and the dust absorption brush wheel 50 and includes a through hole 41 at the center thereof, allowing for insertion of the polygonal tenon 52. The partition sleeve 40 is tightly attached to the mounting cap 20, allowing for interconnection of all components into one body.

Based on the above-mentioned configuration, the vane wheel 30 performs a natural rotation in response to the suction airflow of a vacuum cleaner (not shown) when the above-mentioned dust absorption head and the dust absorption pipe 60 of the vacuum cleaner are joined to each other. Thereafter, the dust absorption brush wheel 50 will be brought into rotation to achieve an expected effect.

Figure 3:
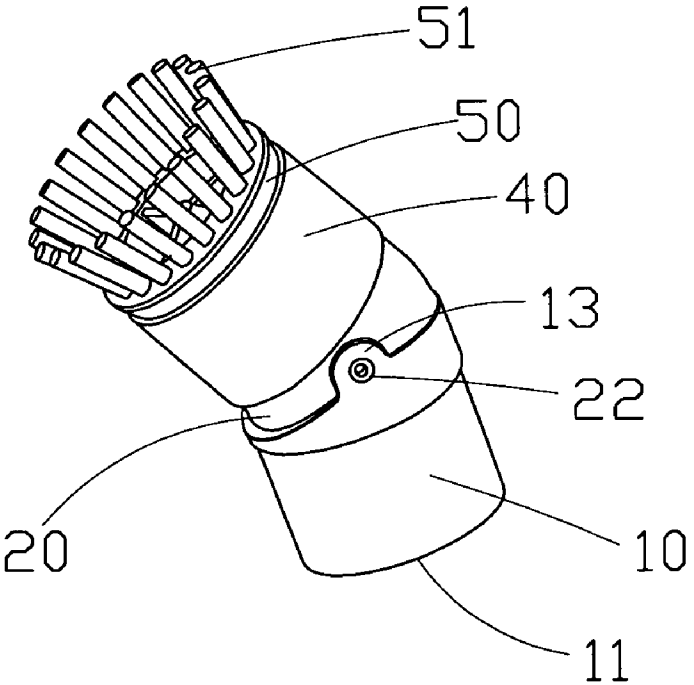
FIG. 3 is a perspective view of the operation in adjusting the coupling angle of the invention.

As shown in FIGS. 2 and 3, the operational angle of the brush 51 is easily adjustable by a simple action according to different requirements. The natural rotation of the dust absorption brush wheel 50 is achieved by the inhere suction airflow without consuming any additional driving power, thereby avoiding the waste of power.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A dust absorption head of a vacuum cleaner, comprising:

a) a main socket tube formed in a hollow shape with an opening end for receiving a dust absorption pipe, a connecting ear with a mortise being disposed at the other end of the main socket tube, an engaging projection being disposed at the internal side of the connecting ear;

b) a mounting cap having a brush-receiving chamber, a pivotal protrusion being formed at the opposite sides of the external wall of the mounting cap, a plurality of positioning holes for engaging purpose being formed near one side of the pivotal protrusion;

c) a dust absorption brush wheel having at the opening end thereof a brush and at the opposing end a polygonal tenon;

d) a vane wheel having a polygonal hole at the center thereof for receiving a screw element to fix the dust absorption brush wheel in place; and e) a partition sleeve interposed between the vane wheel and the dust absorption brush wheel and having a through hole at the center thereof, the partition sleeve being tightly attached to the mounting cap, whereby a free adjustment of the operational angle of the dust absorption head is achieved, and a natural rotation of the vane wheel in response to the suction airflow of a vacuum cleaner is ensured for bringing the dust absorption brush wheel into rotation.

* * * * *